US006766849B1

(12) United States Patent
Tseng

(10) Patent No.: US 6,766,849 B1
(45) Date of Patent: Jul. 27, 2004

(54) CURTAIN TRACK ADJUSTMENT ASSEMBLY

(75) Inventor: Po-Chi Tseng, Changhua (TW)

(73) Assignee: Lian Fa Enterprise Co., Ltd., Changhua (TW)

( * ) Notice: Subject to any disclaimer, the term of this patent is extended or adjusted under 35 U.S.C. 154(b) by 0 days.

(21) Appl. No.: 10/658,328

(22) Filed: Sep. 10, 2003

(51) Int. Cl.[7] ..... E06B 9/56
(52) U.S. Cl. ..... 160/332; 160/900
(58) Field of Search ..... 160/332, 344, 160/330, 184, 168.1 V, 123, 124, 126, 900

(56) References Cited

U.S. PATENT DOCUMENTS 2,633,321 A * 3/1953 Coulter ..... 248/215
3,915,377 A * 10/1975 Sutton, Jr. ..... 236/49.1
4,090,692 A * 5/1978 Jacobs ..... 472/78
4,091,857 A * 5/1978 Jacobs ..... 160/330
4,428,278 A * 1/1984 Sutton, Jr. ..... 454/229
6,042,475 A * 3/2000 Darden ..... 454/274

* cited by examiner

*Primary Examiner*—David Purol
(74) *Attorney, Agent, or Firm*—Troxell Law Office PLLC

(57) ABSTRACT

A curtain track adjustment assembly adopted for use on different sizes of doors and windows enables users to drape curtains as desired. It includes a winch to retract or extend a steel cable. A brake paw is coupled with a spring which provides a restoring force to anchor the brake paw on a ratchet gear of the winch so that the length of the steel cable may be controlled and adjusted to suit different sizes of windows.

3 Claims, 7 Drawing Sheets

CURTAIN TRACK ADJUSTMENT ASSEMBLY

BACKGROUND OF THE INVENTION

1. Field of the Invention

The invention relates to a curtain track adjustment assembly adopted for use on different sizes of doors and windows.

2. Description of the Prior Art

Window coverings such as curtains and shutters have almost become necessary household goods. They not only can block sunshine, also can enhance visual aesthetic appealing. To install a curtain or shutter on the window, curtain brackets must be provided. Conventional curtain brackets are fixedly mounted over the window, and cannot be adjusted. In the event that users want to change the draping location of the curtain, new curtain brackets have to be installed. This causes a lot of waste.

SUMMARY OF THE INVENTION

In view of the aforesaid disadvantages, the object of the invention is to provide a curtain track adjustment assembly that is adaptable to different sizes of doors and windows.

The curtain track adjustment assembly of the invention may be altered according to different sizes of doors and windows to drape curtains or shutters. It includes a winch to retract or extend a steel cable. Every time the winch is turned, a spring coupled on a brake paw generates a restoring force to latch the brake paw on a ratchet gear of the winch thereby can control the steel cable to stretch a desired distance and achieve the adjustment function for the curtain track.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
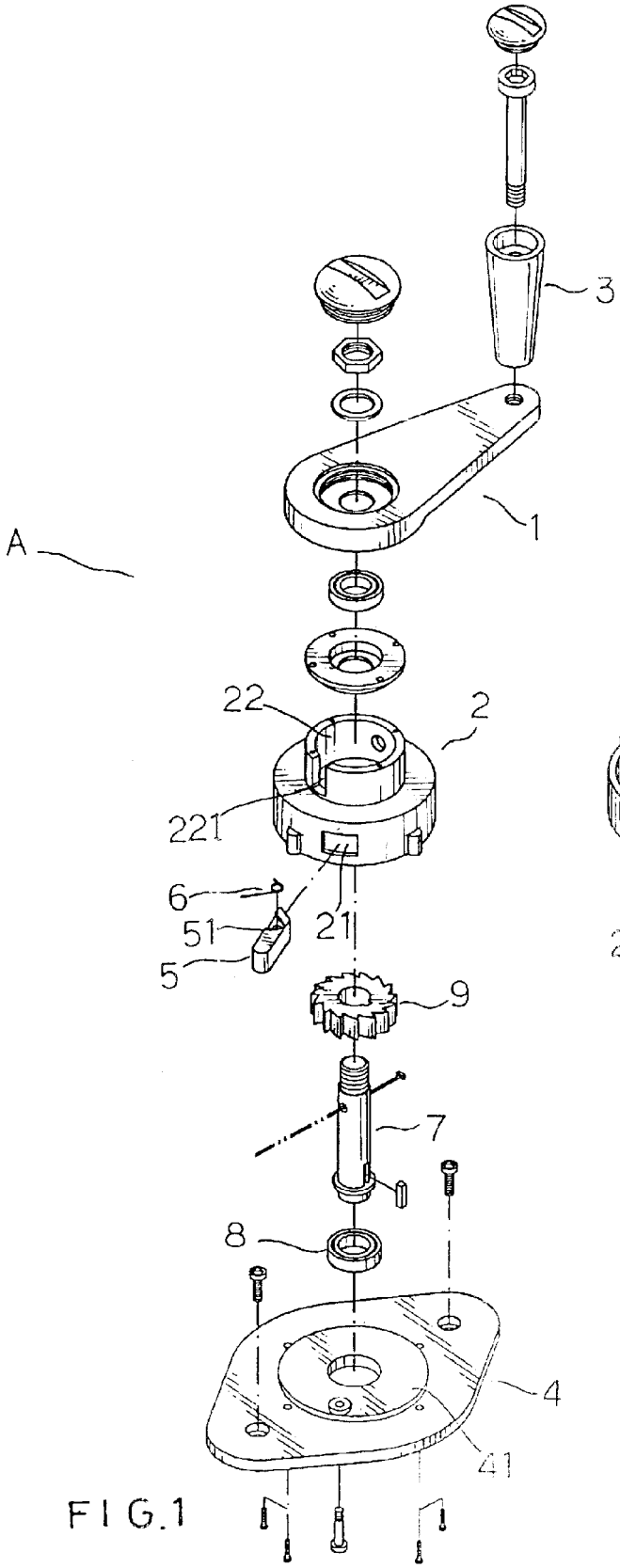
FIG. 1 is an exploded view of the invention.
Figure 2:
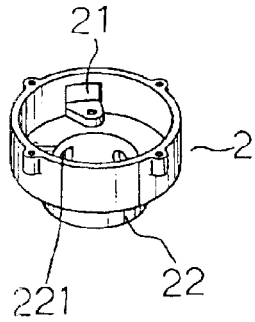
FIG. 2 is a perspective view of the upper cap of the invention.

Referring to FIGS. 1 and 2, the curtain track adjustment assembly according to the invention includes a winch A fixedly located on one side of a window, a crank 1, an upper cap 2, a brake paw 5, a spring 6, an axle 7 and a ratchet gear 9. The crank 1 is fastened to an annular flange 22 which is extended above the upper cap 2 and has one end attached to a handle bar 3. The upper cap 2 is fastened to a bulged rim 41 located in the center of a body 4. The annular flange 22 has a notch 221 on one side. The upper cap 2 has an opening 21 on one side to receive the brake paw 5. The brake paw 5 has a stub 51 on one side to couple with the spring 6. The axle 7 has a bottom end coupling with a bearing 8 and a top end running through the ratchet gear 9. A steel cable 10 is wound on the axle 7. The steel cable 10 has one end fastened to a fastening member 131 of an anchor dock 13 and other end fixedly fastened to the axle 7 of the winch A. The steel cable 10 threads through a plurality of clips 11. The clips 11 may clip curtain (or shutter) slats 12. The anchor dock 13 is mounted on another side of the window to connect to the steel cable 10 through the fastening member 131.

By means of the aforesaid construction, when in use for adjusting the distance, turn the crank 1 of the winch A, the spring 6 has a restoring force to anchor the brake paw 5 on the ratchet gear 9 to facilitate control and adjustment of the length of the steel cable 10, thereby the steel cable 10 may be retracted or extended to adjust the distance for draping the curtain. In the event that users want to change the installation location, the winch A, anchor dock 13 and steel cable 10 may be removed and installed on other location desired. The adjustment assembly may be reused and the length may be adjusted again for draping the curtain. Therefore it is more economic to use.

Figure 4:
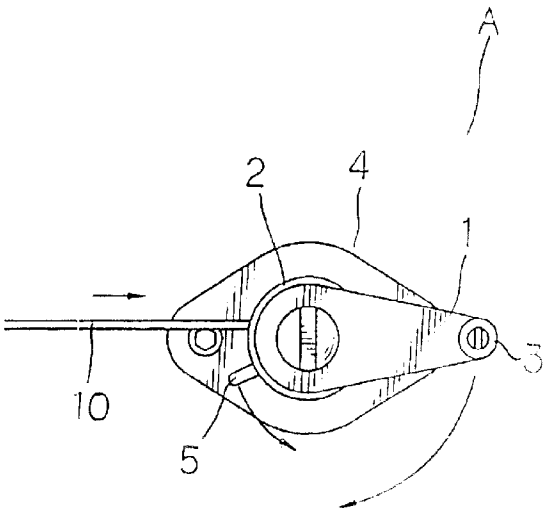
FIG. 4 is a schematic enlarged view of the winch in FIG. 3.
Figure 3:
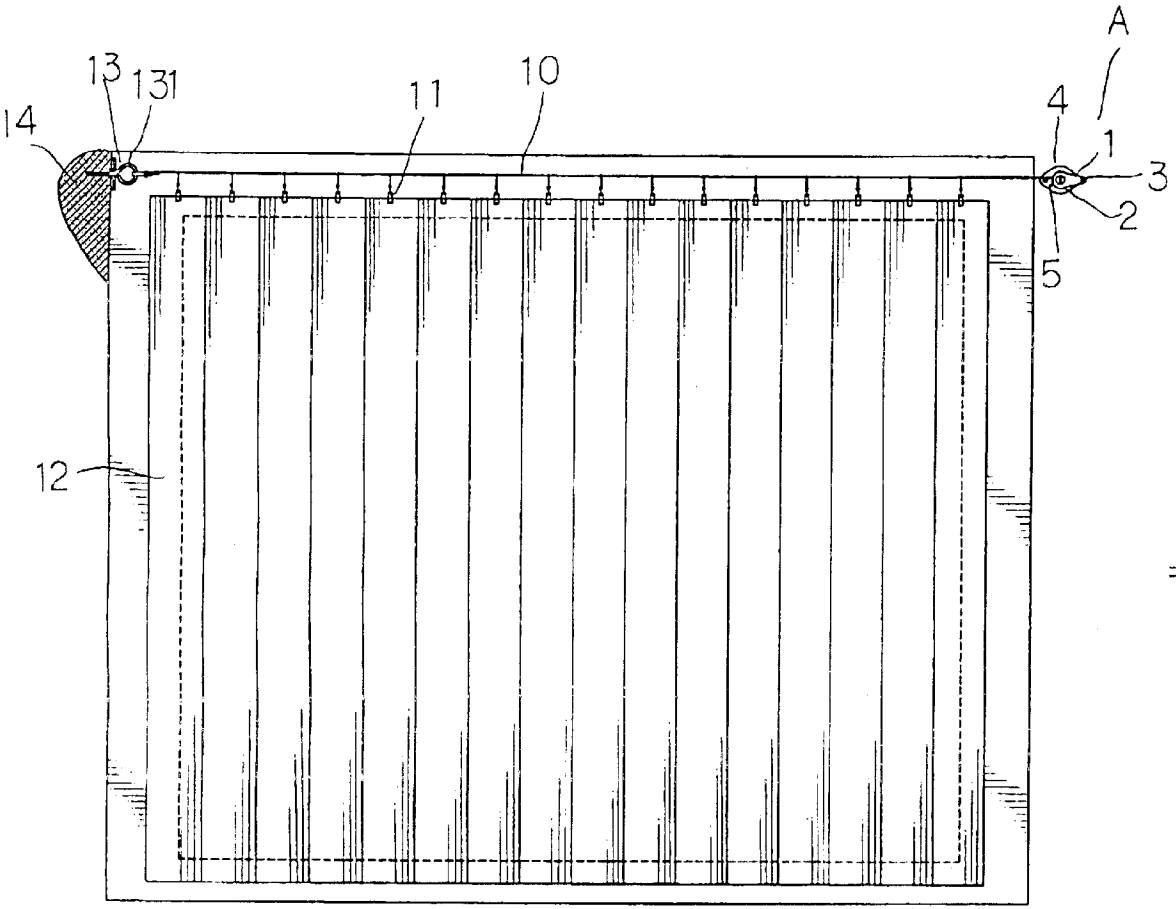
FIG. 3 is a schematic view of an embodiment in a condition of winding for retraction.
Figure 6:
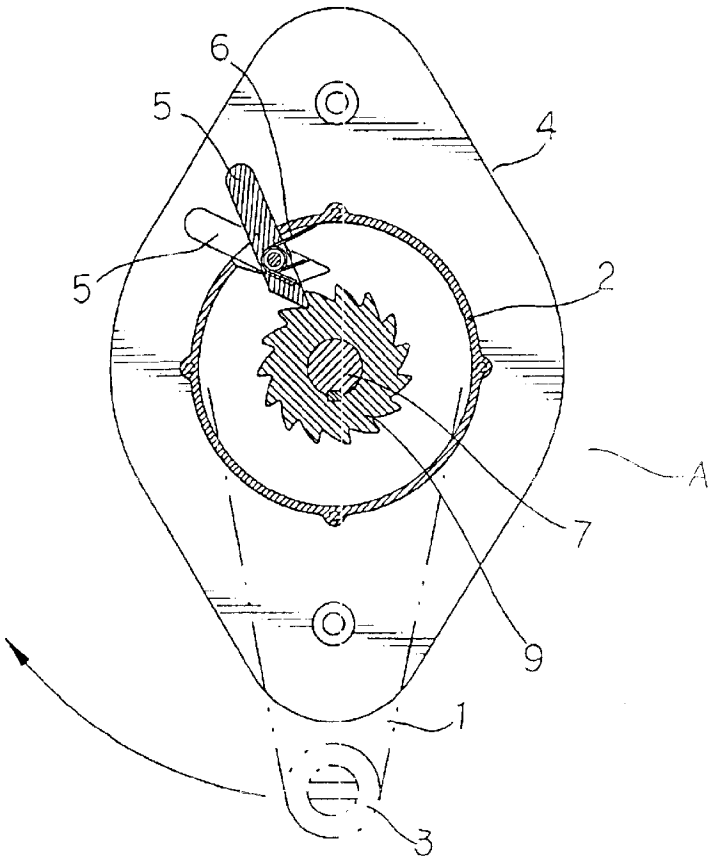
FIG. 6 is a schematic view of the invention in a winding and retracting condition.
Figure 5:
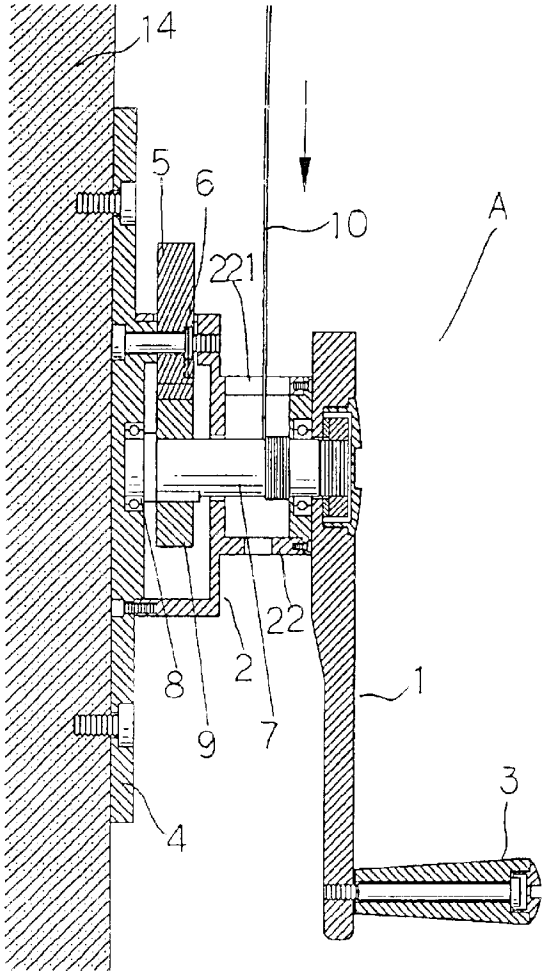
FIG. 5 is a sectional view of the invention in a winding and retracting condition.

Refer to FIGS. 3 through 6 for an embodiment of the invention in use. First, the winch A and the anchor dock 13 are fastened to a wall 14; then the steel cable 10 is fastened between the winch A and the anchor dock 13, and a plurality of clips 11 may be coupled on the steel cable 10; one clip 11 may catch one curtain slat 12. The number of clips 11 may alter depending on requirements. When there is a desire to adjust the distance, turn the crank 1 of the winch A downwards (as shown in FIG. 4), the spring 6 coupled on the brake paw 5 generates a restoring force to anchor the brake paw 5 on the ratchet gear 9 (as shown in FIG. 6) to enable users to wind and retract the steel cable 10 (as shown in FIG. 5) thereby to retract the draping distance (as shown in FIG. 3).

Figure 8:
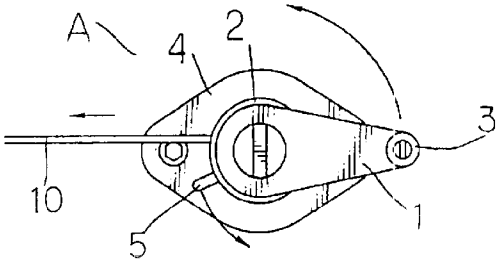
FIG. 8 is a schematic enlarged view of the winch in FIG. 7.
Figure 7:
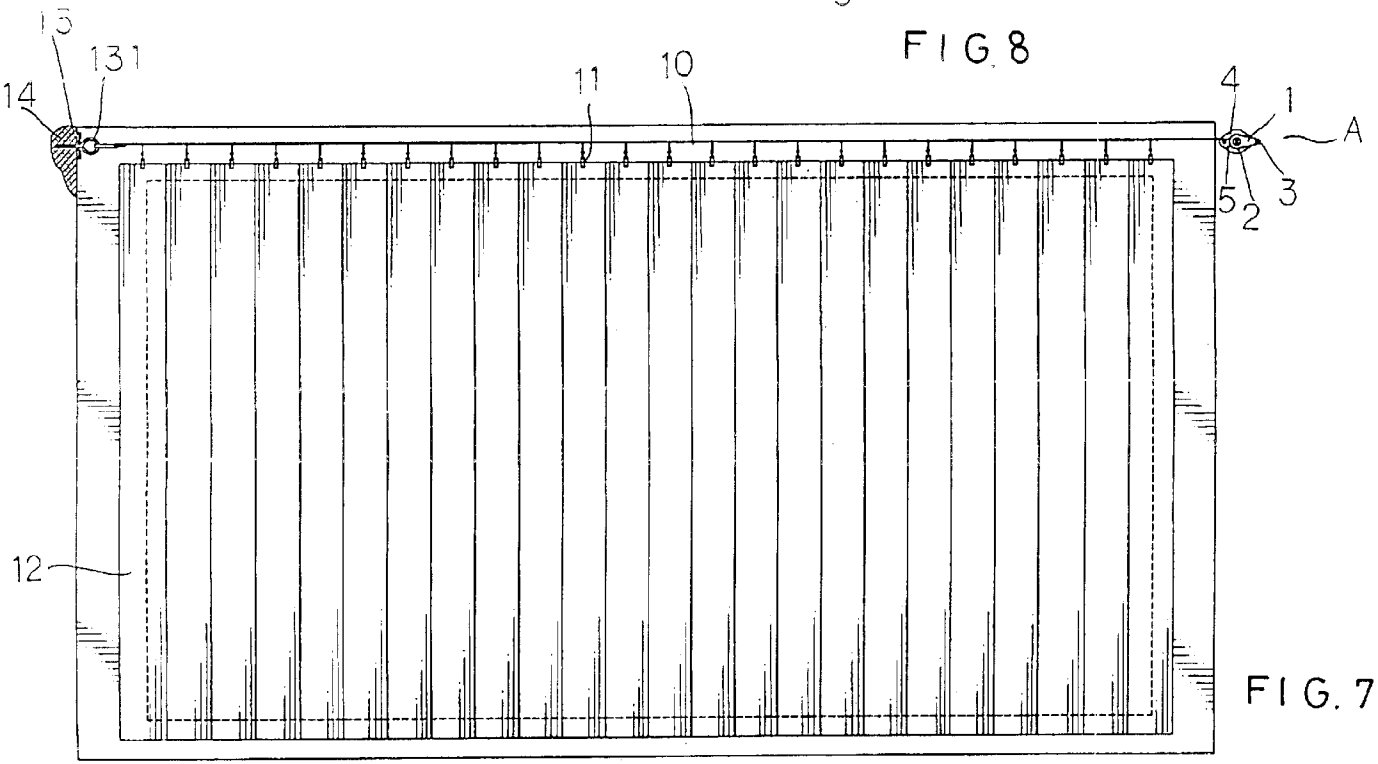
FIG. 7 is a schematic view of an embodiment showing a condition for extending the steel cable.
Figure 10:
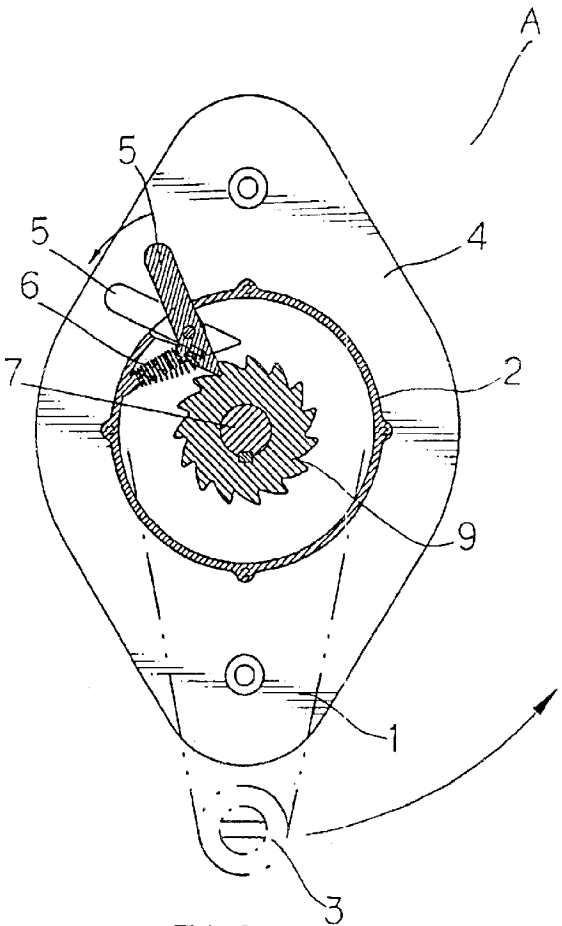
FIG. 10 is a schematic view of the invention in an operation condition for extending the steel cable.
Figure 9:
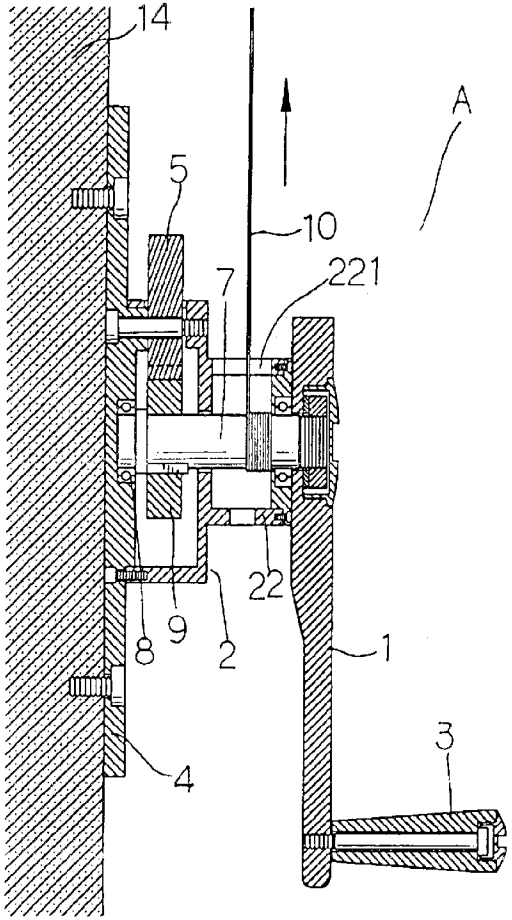
FIG. 9 is a sectional view of the invention in an operation condition for extending the steel cable.

Refer to FIGS. 7 through 10 for the embodiment of the invention in use in another condition. When the crank 1 of the winch A is turned upwards (as shown in FIG. 8), the spring 6 coupled on the brake paw 5 generates a restoring force to anchor the brake paw 5 on the ratchet gear 9 (as shown in FIG. 10) to enable users to wind and extend the steel cable 10 (as shown in FIG. 9) thereby to extend the draping distance (as shown in FIG. 7).

Figure 11:
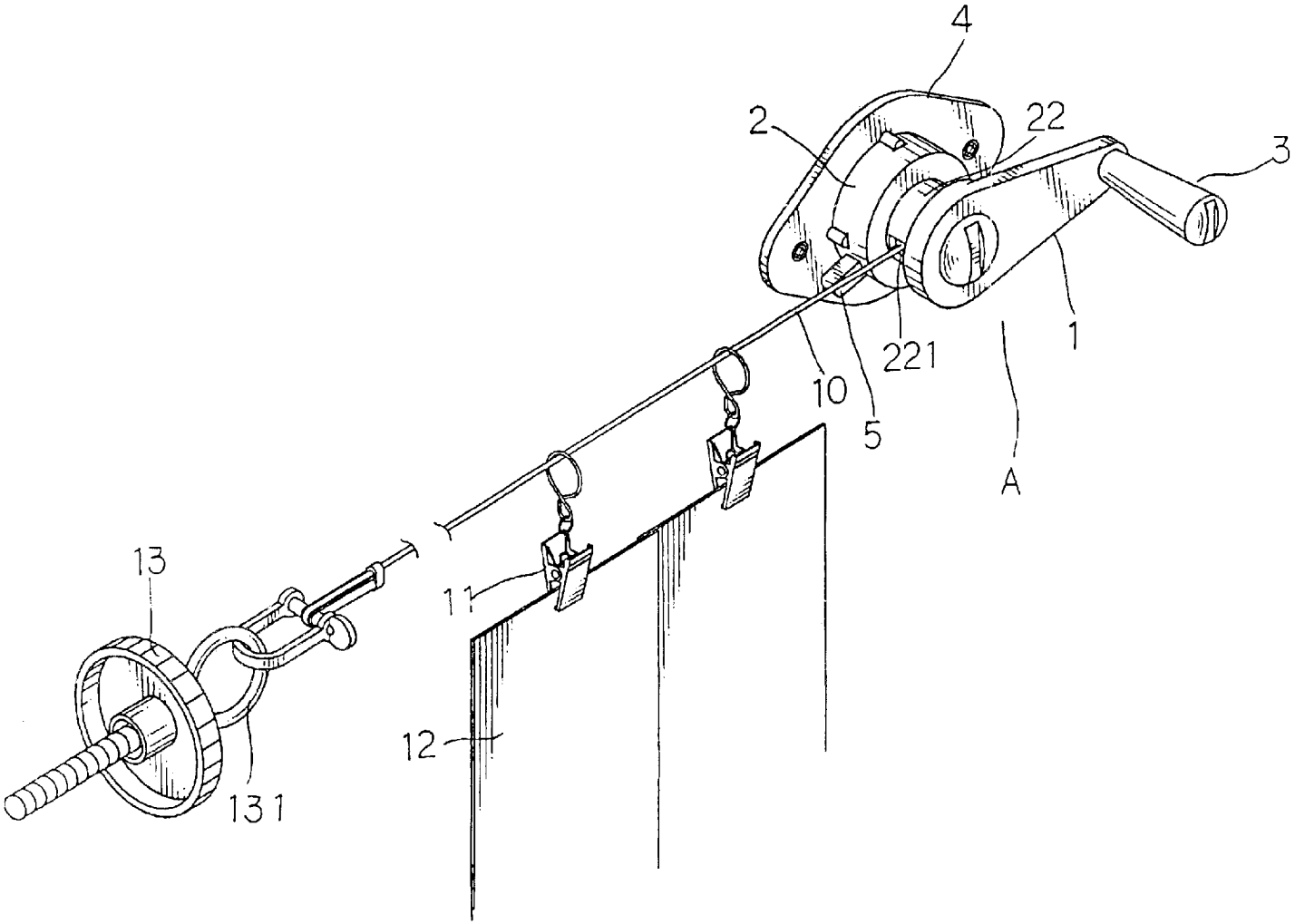
FIG. 11 is a pictorial view of an embodiment of the invention.
Figure 12:
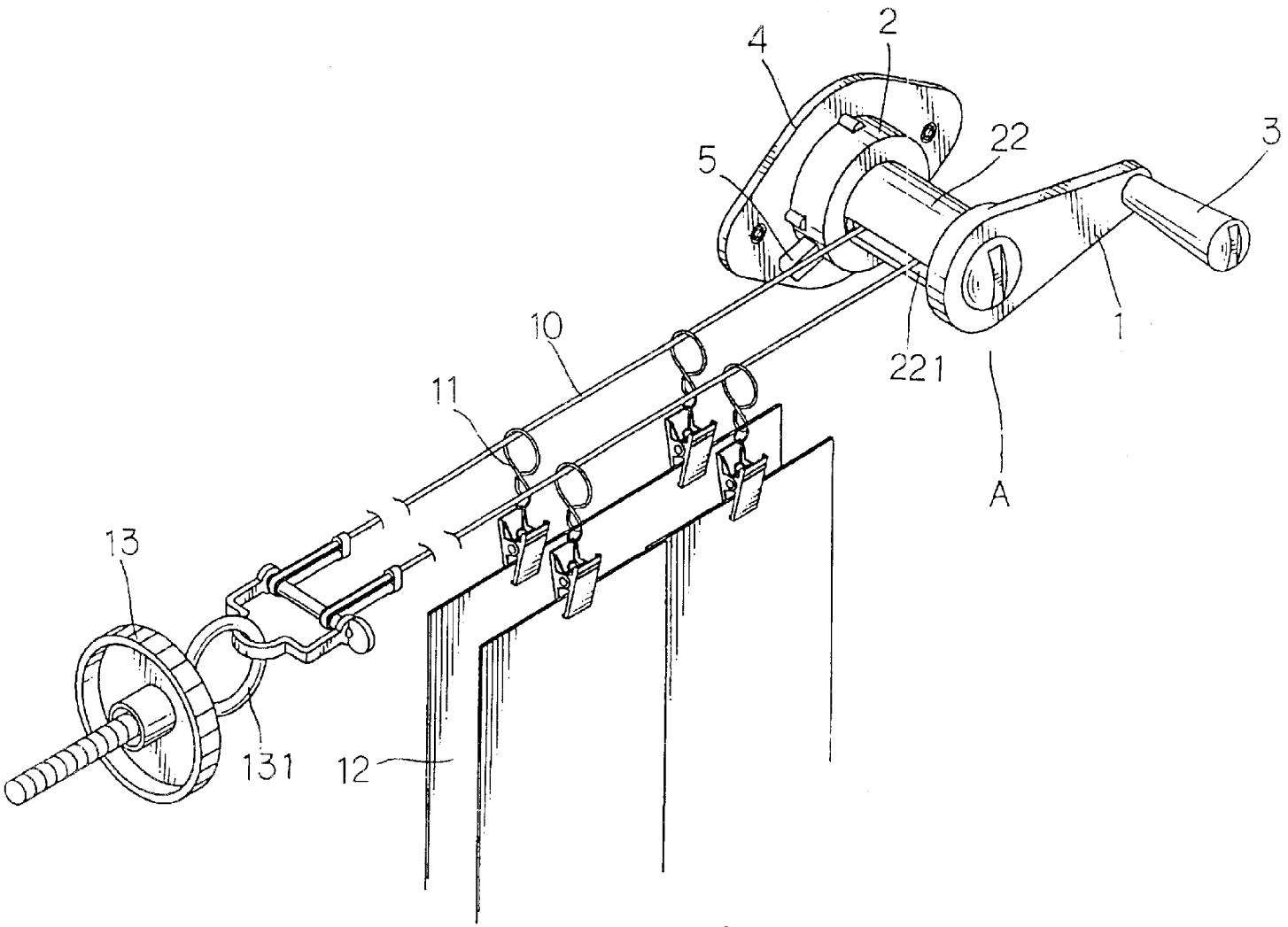
FIG. 12 is a pictorial view of another embodiment of the invention.

Referring to FIG. 11 for an embodiment of the invention in a use condition. FIG. 12 illustrates another embodiment of the invention in which two steel cables 10 are fastened between the fastening member 131 of the anchor dock 13 and the axle 7 of the winch A to drape a double-ply curtain (such as a sunshine mask cloth and a curtain cloth). The draping width may be adjusted according to the size of the window.

In summary, the invention provides improved functions and advantages over conventional curtain brackets, notably:

1. The winch of the invention can extend or retract the length of the steel cable, and the length may be adjusted according to the size of the window. When change installation location is desired, the assembly of the invention may be adjusted again without the need of replacing the old set with new set that occurs to the conventional curtain brackets.

2. The invention may be adjusted according to the size of the window.

When there is a desire to change installation location, the old set may be removed and reused on the new site. It can reduce the cost for consumers and eliminate waste.

While the preferred embodiments of the invention have been set forth for the purpose of disclosure, modifications of the disclosed embodiments of the invention as well as other embodiment thereof may occur to those skilled in the art. Accordingly, the appended claims are intended to cover all embodiments which do not depart from the spirit and scope of the invention.

I claim:

1. A curtain track adjustment assembly, comprising:

a winch fixedly located on one side of a window including a crank , an upper cap, a brake paw, a spring, an axle and a ratchet gear, the crank being fastened to an annular flange extended upwards from the upper cap and having one end attached to a handle bar, the upper cap being fastened to a bulged rim located in the center of a body, the annular flange having a notch on one side, the upper cap having an opening on one side to receive the brake paw, the brake paw having a stub on one side to couple with the spring, the axle having a bottom end coupling with a bearing and a top end running through the ratchet gear;

a steel cable having one end fastened to the axle of the winch; and an anchor dock fixedly located on other side of the window having a fastening member fastened to other end of the steel cable;

wherein the crank is turnable to anchor the brake paw on the ratchet gear through a restoring force of the spring to control and adjust the length of the steel cable.

2. The curtain track adjustment assembly of claim 1, wherein the steel cable is wound on the axle and threads through clips to clip window slats.

3. The curtain track adjustment assembly of claim 1, wherein the fastening member and the axle fasten two steel cables therebetween.

* * * * *